US006219878B1

(12) United States Patent
Dewberry

(10) Patent No.: US 6,219,878 B1
(45) Date of Patent: Apr. 24, 2001

(54) CAULK BEAD TOOL

(75) Inventor: Andrew Dewberry, Vancouver (CA)

(73) Assignee: Vancouver Tool Corporation, Vancouver (CA)

( * ) Notice: Subject to any disclaimer, the term of this patent is extended or adjusted under 35 U.S.C. 154(b) by 0 days.

(21) Appl. No.: 09/420,136

(22) Filed: Oct. 18, 1999

Related U.S. Application Data

(63) Continuation of application No. 09/051,215, filed as application No. PCT/CA96/00657 on Oct. 1, 1996, now abandoned.

(30) Foreign Application Priority Data

Oct. 3, 1995 (CA) ..... 2158873

(51) Int. Cl.[7] ..... B05C 17/10
(52) U.S. Cl. ..... 15/235.7; 425/458; D8/45
(58) Field of Search ..... 15/235.3, 235.7, 15/245.1; 425/458; D8/45

(56) References Cited

U.S. PATENT DOCUMENTS

| | | | |
|---|---|---|---|
| 3,498,101 | 3/1970 | Daniell | 72/479 |
| 3,744,079 | 7/1973 | Krause | 15/235.7 |
| 3,761,992 | 10/1973 | Schneller | 425/458 X |
| 3,846,060 | 11/1974 | Otis | 15/235.7 X |
| 3,878,581 | 4/1975 | Perna | 15/235.7 |
| 4,586,890 | 5/1986 | Marchbanks | 425/458 |
| 4,673,346 | 6/1987 | Anderson | 425/458 |
| 5,018,956 | 5/1991 | Lemaster | 15/235.7 |
| 5,033,951 | 7/1991 | Cook | 425/458 X |
| 5,075,916 | 12/1991 | Englehart | 15/245.1 |
| 5,239,725 | 8/1993 | White | 15/245.1 |
| 5,440,776 | 8/1995 | Kartler | 15/235.7 |
| 5,675,860 | 10/1997 | Campbell | 15/235.7 |

FOREIGN PATENT DOCUMENTS

| | | |
|---|---|---|
| 385244 | 12/1932 | (GB) . |
| 844416 | 8/1960 | (GB) . |
| 94/27001 | 11/1994 | (WO) . |

*Primary Examiner*—Mark Spisich
(74) *Attorney, Agent, or Firm*—Kolisch Hartwell Dickinson McCormack & Heuser

(57) ABSTRACT

A hand held tool for the uniform compressing, forming and simultaneous cleaning of a previously applied bead of caulking or other similar fluent material from a constructed joint. The tool includes an elongated handle and triangular head with working edges, the working edges being essentially an arrow-like shaped pieced or rubber-like material fixed to and extending slightly beyond the acute isosceles triangular shaped head portion of the tool at the extremity opposite an elongated handle, the acute angle of the working edges at the extremity is slightly rounded. The head and the handle contain a continuous longitudinal cavity provided for the collection of excess material gathered during the operation of the tool and in the preferred embodiment the head and handle are essentially molded as one unit in resilient plastic material with the handle expanding in a fan-like shape the outer angles of the head.

24 Claims, 1 Drawing Sheet

CAULK BEAD TOOL

CROSS REFERENCE TO RELATED APPLICATIONS

This application is a continuation of application Ser. No. 09/051,215, filed Apr. 2, 1998, now abandoned which is a 371 of PCT/CA96/00657 filed Oct. 1, 1996.

BACKGROUND OF THE INVENTION

This invention relates generally to tools utilize for contouring and finishing beads of caulk, grout, putty and other fluent materials (hereinafter referred to only as "caulk"). More particularly, the invention relates to apparatus for compressing and contouring beads of fluent Material freshly applied to joints, and for the simultaneous removal of excess fluent material from the sides of the joints.

Many tools are available in the prior art for contouring and finishing beads of caulk applied to intersecting planar surfaces. Some such tools teach a one-step application and contouring of a bead of fluent material within a joint, other tools are used after the initial bead of caulk has been applied to finish the bead uniformly. A few such tools disclosed purport to be able to avoid excess distribution of fluent materials in the first instance but most are devoid of any teaching or recognition of potential clean up problems along the sides of an applied and contoured bed. Some other tools available in the prior art teach an additional clean-up step to the process of producing a finished uniform bead of caulking between intersecting planar surfaces devoid of excess caulking material. However, to the extent that they may not always satisfactorily perform in the manner suggested, the tools disclosed are inadequate to remove such excess material.

Many of the tools in the prior art are constructed in a complex manner especially where the initial application of a uniform caulk bead is the preferred method of operation. This complexity reduces the potential use of such tools under most job conditions encountered by this inventor.

Moreover even those such tools which are of simple construction and operation compete under job conditions with more readily available traditional methods of caulking finishing tools such as a moistened finger or palette knife, which though messy and imprecise continue to be the foremost methods of finishing caulk beads. Such work practices hold the benefit to the employer of resilience and flexibility, although a few tools available in the prior art also teach resilience and flexibility of construction, none can offer flexibility of use required to achieve uniform beads of caulk in many instances especially where the adjacent surfaces are not perpendicular or include non-conformities such as joints, cracks or surface texture.

SUMMARY OF THE INVENTION

The resilient and flexible hand held tool of the present invention provides a handle with a fixed head holding working edges for uniformly compressing and contouring an applied bead of caulk and the simultaneous removal of excess material from the contoured bead and adjacent surfaces.

In a preferred form the tool comprises an elongated handle and isosceles acute triangular shaped head portion firmly holding the working edges. In this preferred embodiment the said handle and head portions are constructed in one piece from a resilient plastic material with the head portion located symmetrically at one end of the said handle and at an angle extending way from the central axis of the handle, the acute angle thereby directed axially away from the handle. The working edges are two edges of a six-sided arrow-shaped single flat sheet of durable elastomer or gasket rubber-like material which join at an acute angle. This said shaped sheet is held by and extends slightly beyond, the triangular head at the axial extremity of the handle, the said acute angled end is rounded and is so disposed to form a bead of caulk into a desired curvature and the two edges of the working surfaces extending symmetrically from the rounded end are disposed to wipe clean any excess caulk from the surfaces adjoining the caulk joint towards the axis of the tool during a pass of the tool over a previously applied bead of caulk In this preferred embodiment the excess material so gathered is collected in a cavity running longitudinally within the head and into the handle portions of the tool.

DETAILED DESCRIPTION OF A PREFERRED EMBODIMENT

Figure 1:
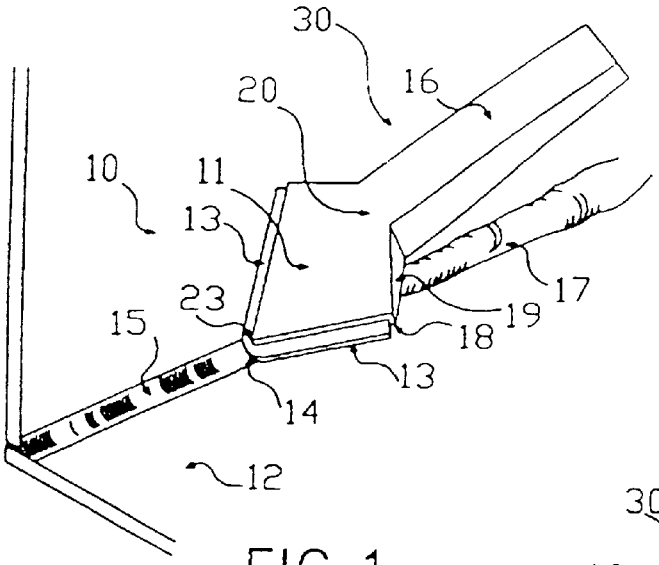
FIG. 1 is a perspective view of a preferred embodiment of the tool of the present invention, shown applied against a bead of previously applied caulk to form the caulk into a finished concave bead joint.

Referring to FIG. 1 a preferred embodiment of a caulk bead tool of the present invention 30 is shown physically supported against two intersecting elements 10 and 12 which form a joint 15 to which rough bead of caulk 17 has been freshly dispensed. The rounded end 14 of the working edges 13 is in contact with the rough bead and is pulled along the bead to compress the caulk into the joint and to form a finished smooth concave bead of caulk and to wipe clean excess material from the adjacent surfaces of the two intersecting elements.

The elongated body of the tool is a handle 16 which in the preferred form is approximately 100 mm. long and 20 mm. wide and varies between 10 mm. and 15 mm. high. At the said thicker end the handle widens in a planar fan shape 19 to form a structurally confluent junction 20 with the isosceles acute triangular head portion 11. The head 11 extends axially approximately 35 mm. beyond the end of the handle and narrows from 45 mm. wide at the confluence to a point 23 directed axially away from the handle. This head is substantially a flat element approximately 4 mm. thick which is reduced to 2 mm. along the outer edges of the triangular head where a rebate of approximately 6 mm. width is formed to support the working edges. In the preferred embodiment the body and head portion are molded from resilient plastic material. The shaping at the junction between the handle and the head 11 in this embodiment also facilitates collection of excess caulk from the working edges and ease of holding and in the hand. The working edges are substantially a symmetrical six-sided arrow-like shaped piece die-cut from a single sheet of elastomeric or gasket rubber-like material approximately 2 mm. thick. The outer edges of the said arrow-like shape are approximately 40 mm. in length (see FIG. 4) and extend beyond the head by approximately 2 mm. the said edges form an acute angle at the axial extent of the tool remote from the handle and this angle is rounded to achieve the desired finished form of a concave bead of caulk (see FIG. 3). The said working edges are rigidly held within the said rebate through the use of glue, snap moldings or other similar practice known to ensure firmness of location in the prior art connections and plastics molding techniques, the rebate 18 is stopped at the short edges of the said arrow-like shape, head is rigidly held to the glued or otherwise fixed into.

Figure 2:
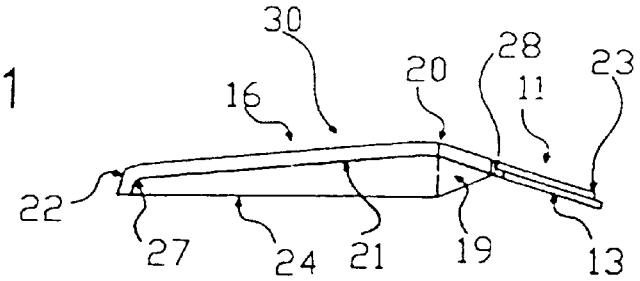
FIG. 2 is a side view of the tool of FIG. 1

Now referring to FIG. 2 where the shaping of the tool in this preferred embodiment is shown in side view. The axial extremity 22 of the handle remote from the head is angled acutely to the base plane of the underside face 24 of the tool. This end forms an obtuse angle with the main longitudinal upper face of the tool which itself slopes towards a structurally stronger thickening at the confluence 20 of the handle and head. The head portion 11 slopes away from the said confluence towards the plane of the said underside face. The solid structure of the head is rebated to retain the thin working edges and through the angling of the said head obtusely from the said handle these edges are directed at a greater angle than the handle to the caulk bead joint this having been found by the present inventor to be an optimum solution for comfort of the operator and the creation of an ideal formed bead. In this preferred form the head ends perpendicularly at the previously noted plane of the underside 24 of the tool. The working edges extend approximately 2 mm. beyond the supporting head such that under a slight pressure the working edges will flex and compress into deviations in the planes of the intersecting elements adjacent to the caulk joint and will simultaneously wipe dean the said faces.

The sides of the tool are shaped at the junction 20 to form triangular cheeks 19 to the head portion. The reduction of the sides towards the end of haunching to the rebate 18 which holds the working edges facilitates the rigidity of the head and allows the operator to maneuver the tool to a very acute angle with the caulk bead and thus to achieve smooth finished caulk beads in joints between elements of other than mutually perpendicular and planar disposition. The said cheeks to the head which are contiguous with the sides of the handle also create a funneling collection area for excess material derived during an operation to compress and smooth a rough caulk bead. The said excess is then directed into a cavity which is substantially the underside of the tool extending from the head longitudinally along the handle. This cavity is terminated in the presently preferred embodiment in a smoothly curved end within the axial extremity of the handle remote from the head for ease of cleaning.

Figure 3:
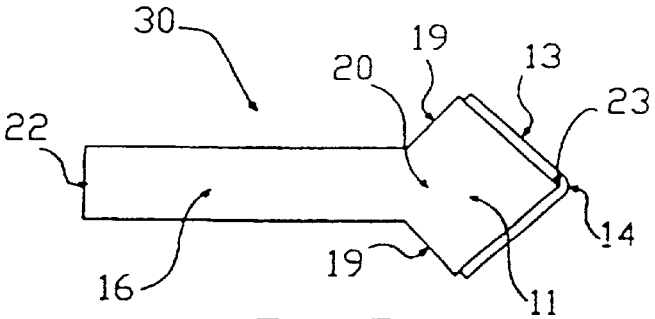
FIG. 3 is a top face view of the same tool

Referring to FIG. 3 there is shown the top face view of the same tool 30 of the presently preferred embodiment. In this view the axial symmetry of the tool is shown with the elongated handle 16 describing a rectangular form up to the said fan shaped confluence 20 with the said acute isosceles triangular head 11. The acute angle 23 of the said head is located axially at the extremity of the tool remote from the said handle and the rounded acute angle 14 of the said working edges extends shortly beyond. The said working edges extend beyond the said head along both sides of the said head at the anal extreme of the tool and is seated firmly and glued or otherwise fixed in the said rebate formed in the face of the said head continuous with the said longitudinal cavity and which is stopped at the extremity short edges of the said working edges (see in FIG. 4). The tool thus resists excessive flexing of the working edges when put under pressure during an operation to smooth a bead of caulk maintaining the preferred action of evenly compressing, smoothing and cleaning of the rough bead.

Figure 4:
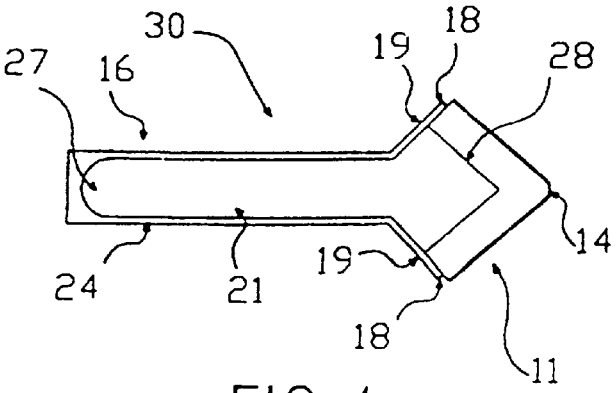
FIG. 4 is an under face view of the same tool

FIG. 4 shows the extent and shape of the elongated cavity 21 extending substantially the length of the tool towards the axial end of the said handle remote from the said head ending in a smooth and rounded concavity 27 for ease of cleaning. The said side cheeks 19 to the confluence of the said handle and said head 11 are shown forming a funnel shape which corresponds to and is a continuation of; the sides to the said handle into the fanning incorporated at the said confluence 20. As noted above the said cheeks introduce additional structural stability and direct excess caulk material extracted during an operation upon a bead of caulk towards the said collection cavity away from the site of the caulk joint. The base of the said cavity is substantially flat and contours closely the upper face contours of the body of the tool of the presently preferred embodiment (see FIG. 2). The said rebate 18 in the said head is formed to house the working edges six-sided sheet 28 accurately to ensure that the substantially flat base of the said collection cavity is substantially level with the face of the said sheet and the sheet is supported substantially along its opposite, hidden face and substantially along four edges.

Figure 5:
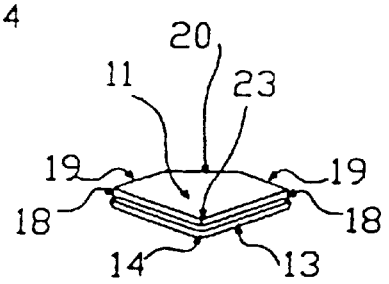
FIG. 5 is an end view of the same tool

FIG. 5 is an end view of the tool of the presently preferred embodiment showing the said planar and angled head 11 and the said confluence of the said head with the said handle with the said supported working edges 13 continuous to the haunching to the rebate 18 extending beyond the said head to the extremity of the tool.

Although only one presently preferred embodiment is shown and described herein, numerous additional embodiments are envisioned to fall within the scope and spirit of this invention and the following claims.

I claim:

1. A tool for compressing and smoothing a bead of freshly applied fluent material in a joint at the intersection of two adjacent surfaces and simultaneously cleaning excess of said material from the bead and the adjacent surfaces, comprising:

an elongate handle formed with a cavity extending substantially the length of the handle;

a working head at one end of the handle, the head being of generally planar triangular shape that extends forwardly from the handle;

a sheet of elastomer material affixed to the head and having exposed outer edges that define working edges of the tool; and whereby manipulation of the tool by hand by inserting the working edges against a bead of fluent material at the intersection of the two adjacent surfaces and pulling the tool along the bead while applying a slight pressure causes the working edges to flex to compress and smooth the bead while simultaneously cleaning the adjacent surfaces of excess material which is collected in the cavity of the handle.

2. The tool of claim 1 wherein the head extends downwardly from the handle.

3. The tool of claim 1 in which the handle and the working head are formed as a unitary member from resilient plastic.

4. The tool as claimed in claim 1 in which the elastomer material is removably mountable to the head.

5. The tool as claimed in claim 1 adapted to receive elastomer material having rounded acute angles of different radii to permit adjustment of a concavity of a finished caulking bead.

6. The tool as claimed in claim 1, in which the head is formed with a rebate to receive the elastomer material.

7. The tool as claimed in claim 6 including snap mouldings in the rebate to hold the elastomer material.

8. The tool as claimed in claim 1, in which the working head and handle are formed with downwardly extending walls defining a passage to assist in directing excess fluent material to the cavity of the handle.

9. A tool for compressing and smoothing a bead of freshly applied fluent material in a joint at the intersection of two adjacent surfaces and simultaneously cleaning excess of said material from the bead and the adjacent surfaces, comprising:

an elongate handle formed with a cavity extending substantially the length of the handle;

a working head at one end of the handle, the head being of generally planar triangular shape that extends forwardly from the handle;

a sheet of elastomer material affixed to the head by snap mouldings, and having exposed outer edges that define working edges of the tool; and whereby manipulation of the tool by hand by inserting the working edges against a bead of fluent material at the intersection of the two adjacent surfaces and pulling the tool along the bead while applying a slight pressure causes the working edges to flex to compress and smooth the bead while simultaneously cleaning the adjacent surfaces of excess material which is collected in the cavity of the handle.

10. The tool of claim 9 wherein the head extends downwardly from the handle.

11. The tool of claim 9 in which the handle and the working head are formed as a unitary member from resilient plastic.

12. The tool as claimed in claim 9 in which the elastomer material is removably mountable to the head.

13. The tool as claimed in claim 9 adapted to receive elastomer material having rounded acute angles of different radii to permit adjustment of a concavity of a finished caulking bead.

14. The tool as claimed in claim 9, in which the head is formed with a rebate to receive the elastomer material.

15. The tool as claimed in claim 14 wherein the snap mouldings are in the rebate to hold the elastomer material.

16. The tool as claimed in claim 9, in which the working head and handle are formed with downwardly extending walls defining a passage to assist in directing excess fluent material to the cavity of the handle.

17. A tool for compressing and smoothing a bead of freshly applied fluent material in a joint at the intersection of two adjacent surfaces and simultaneously cleaning excess of said material from the bead and the adjacent surfaces, comprising:

an elongate handle formed with a cavity extending substantially the length of the handle;

a working head at one end of the handle, the head being of generally planar triangular shape that extends forwardly from the handle and terminates at an acute angle remote from the handle;

a symmetrical, arrow-shaped flat sheet of elastomer material affixed to the head along shorter inner edges of the elastomer material to define working edges comprising the exposed outer edges of the sheet of elastomer material, the elastomer material being formed with an acute angle which is rounded and which extends beyond the acute angle of the head; and whereby manipulation of the tool by hand by inserting the working edges against a bead of fluent material at the intersection of the two adjacent surfaces and pulling the tool along the bead while applying a slight pressure causes the working edges to flex to compress and smooth the bead while simultaneously cleaning the adjacent surfaces of excess material which is collected in the cavity of the handle.

18. The tool of claim 17 wherein the head extends downwardly from the handle.

19. The tool of claim 17 in which the handle and the working head are formed as a unitary member from resilient plastic.

20. The tool as claimed in claim 17 in which the elastomer material is removably mountable to the head.

21. The tool as claimed in claim 20 adapted to receive elastomer material having rounded acute angles of different radii to permit adjustment of a concavity of a finished caulking bead.

22. The tool as claimed in claim 20, in which the head is formed with a rebate to, received the elastomer material.

23. The tool as claimed in claim 22 including snap mouldings in the rebate to hold the elastomer material.

24. The tool as claimed in claim 17, in which the working head and handle are formed with downwardly extending walls defining a passage to assist in directing excess fluent material to the cavity of the handle.

* * * * *